United States Patent [19]

Rival

[11] Patent Number: 4,877,929

[45] Date of Patent: Oct. 31, 1989

[54] BREAKING DEVICE FOR MULTIPOLE ELECTRICAL CIRCUIT BREAKER WITH MULTIPLE CONTACTS

[75] Inventor: Marc Rival, Virieu Sur Bourbre, France

[73] Assignee: Merlin Gerin, France

[21] Appl. No.: 233,032

[22] Filed: Aug. 17, 1988

[30] Foreign Application Priority Data

Aug. 31, 1987 [FR] France ..... 87 12117

[51] Int. Cl.[4] ..... H01H 33/12

[52] U.S. Cl. ..... 200/146 R; 200/144 R

[58] Field of Search ..... 200/146 R, 144 R

[56] References Cited

U.S. PATENT DOCUMENTS

| | | | |
|---|---|---|---|
| 3,582,966 | 6/1971 | Strobel | 200/144 R |
| 3,749,867 | 7/1973 | Rexroad | 200/146 R |
| 3,784,775 | 1/1974 | Gryctko | 200/144 R |
| 4,086,460 | 4/1978 | Gillette | 200/146 R |
| 4,295,022 | 10/1981 | Robin | 200/146 R |
| 4,477,704 | 11/1984 | Mori et al. | 200/144 R |

FOREIGN PATENT DOCUMENTS

| | | |
|---|---|---|
| 0138174 | 4/1985 | European Pat. Off. . |
| 0206882 | 12/1986 | European Pat. Off. . |
| 0225207 | 6/1987 | European Pat. Off. . |
| 2483124 | 11/1981 | France . |
| 2484135 | 11/1981 | France . |
| 2484136 | 12/1981 | France . |

*Primary Examiner*—Robert S. Macon

*Attorney, Agent, or Firm*—Arnold, White & Durkee

[57] ABSTRACT

An arc extinguishing chamber with plates, for a high-rating low voltage circuit breaker, interrupts an arc generated by a multiple contact system having a set of movable main contacts and a movable arcing contact cooperating with corresponding stationary contacts fixed onto a contact terminal. A lower arcing horn is fixed to the terminal by means of three screws with an insulating shield interposed. A pair of jaws with an inclined portion follows the outline of the plates up to the vicinity of intermediate arc catching ridges disposed symmetrically in relation to the center line passing through the V-shaped notch.

5 Claims, 3 Drawing Sheets

Fig. 3
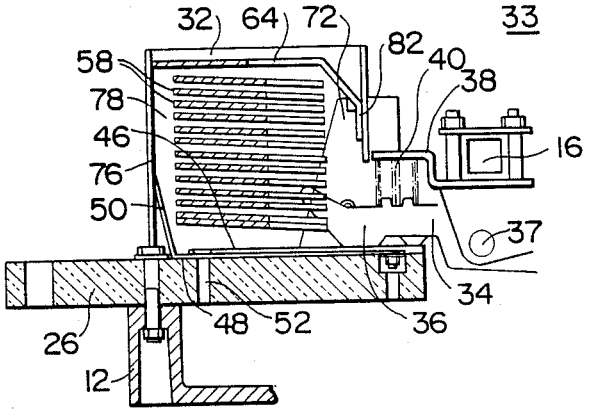
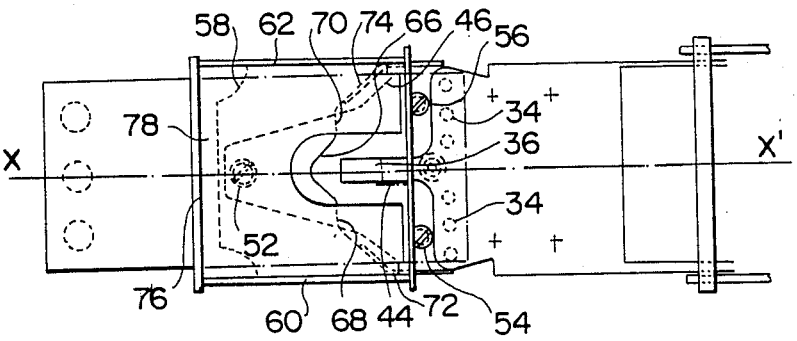
Fig. 4

BREAKING DEVICE FOR MULTIPOLE ELECTRICAL CIRCUIT BREAKER WITH MULTIPLE CONTACTS

BACKGROUND OF THE INVENTION

The invention relates to a breaking device for a multipole electrical circuit breaker with a molded insulating case housing an operating mechanism coupled to a switching bar to provide closing and opening of all the circuit breaker poles, each pole comprising :

a pair of fixed current-conducting terminals, bearing on the base of the case, an arc extinguishing chamber disposed above the first terminal, and comprising a stacking of metal arc deionization plates, each plate having a V-shaped notch, a multiple contact system having a plurality of identical movable main contacts, divided into two sets of the same number on either side of a movable arcing contact extending longitudinally according to the center line of the pole, said contacts being pivotally mounted on an axis of a support tunnel securedly united to the bar, and cooperating with corresponding stationary contacts fixed on the internal end of the first terminal, the length of the movable arcing contact being greater than that of each movable main contact, and a pair of lower and upper arcing horns surrounding the stacking of arc extinguishing chamber plates, the lower arcing horn being securedly united to the upper face of the first terminal with an insulating shield interposed.

The arc forms in the arcing contact separation area located along the center line of the pole, and then develops in the central area of the chamber. Absorption of the arc energy takes place mainly in this area, and the arc remains centered until it is extinguished. In some breaking cases, the hot surfaces of the central area oppose total deionization of the arc, and it is then necessary to increase the number or the surface of the plates to the detriment of the dimensions of the extinguishing chamber.

The object of the invention is to improve the breaking performances of a high-rating multipole circuit breaker.

SUMMARY OF THE INVENTION

The breaking device according to the invention is characterized in that the arc extinguishing chamber comprises in addition, a pair of arc guiding jaws, made of gas-producing insulating material, each having an inclined portion following the outline of the plates up to the vicinity of an intermediate arc catching ridge, and that the lower arcing horn is fixed to the first terminal by means of three screws or rivets disposed at the peaks of an isoceles triangle, one of the screws being situated along the center line of the pole in the vicinity of an edge of the insulating shield penetrating into a rear gap arranged between the plates and an outlet wall of the breaking gases to the outside.

In the course of the circuit breaker opening phase, the arc is switched from the central area to a lateral area bounded by the guiding jaw and the corresponding intermediate ridge of each plate. The arc develops in this lateral area, encountering cold surfaces favoring its extinction.

An arc extinguishing chamber of this kind is particularly well-suited for circuit breakers with a 3000 A rating which have to provide single-phase breaks at a voltage of 600 Volts.

BRIEF DESCRIPTION OF THE DRAWINGS

Other advantages and features will become more clearly apparent from the following description of an illustrative embodiment of the invention, given as a non-restrictive example only and represented in the accompanying drawings, in which :

FIG. 3 is a detailed sectional view of the breaking device in FIG. 1, the circuit breaker being represented in the closed position;

FIG. 4 is a plan view of FIG. 3;

DESCRIPTION OF THE PREFERRED EMBODIMENT

Figure 1:
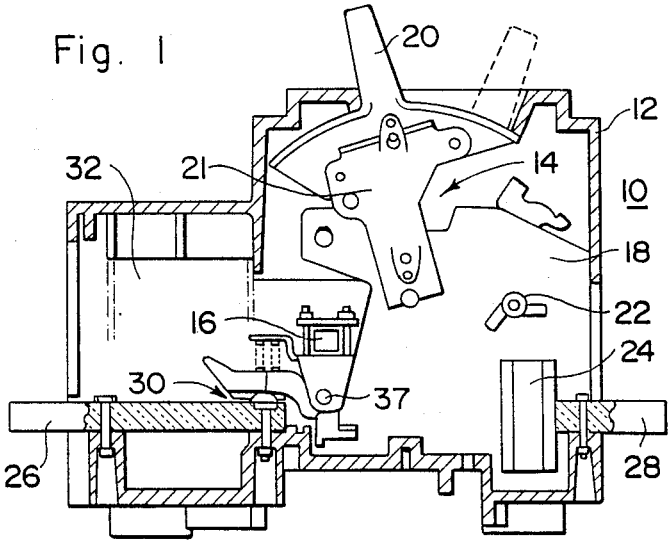
FIG. 1 is a schematic longitudinal sectional view of a circuit breaker pole according to the invention.

The multipole circuit breaker 10 with a molded insulating case 12, illustrated in FIG. 1, is of the type described in French Pat. Nos. 2,493,035, 2,484,135 and 2,484,136 filed by the applicant. The case 12 houses an operating mechanism 14 coupled to a transverse bar 16 common to all the poles. The mechanism 14 is housed between two plates 18 above the central pole, and is controlled either manually by a handle 20 mounted on a rocker cradle 21, or automatically by a trip device, only the trip bar 22, and a current sensor 24 of which have been represented. Each pole comprises a pair of fixed current-conducting terminals 26, 28, a separable contact system 30 cooperating with the mechanism 14 to close or interrupt the electrical circuit of the pole, and an arc extinguishing chamber 32, located above the terminal 26. The rectangular-shaped conducting terminals 26, 28 bear on the base of the insulating case 12.

Figure 2:
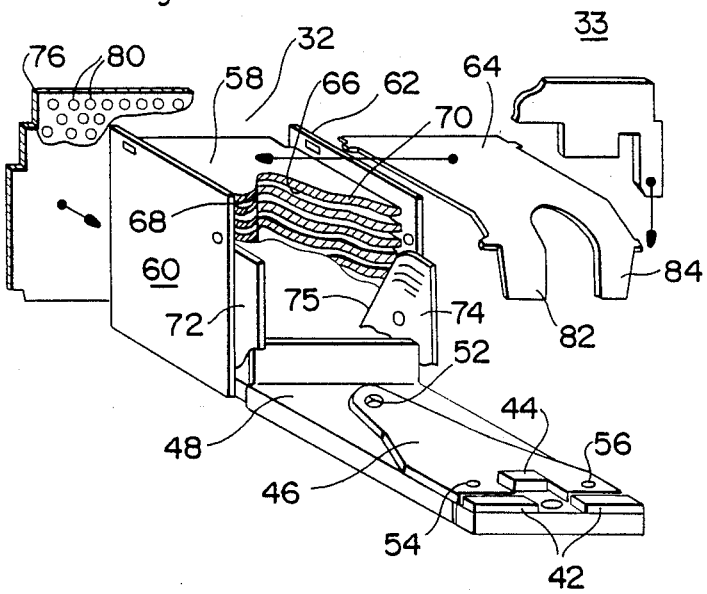
FIG. 2 shows an exploded perspective view of the breaking device, the movable contacts not being represented.
Figure 5:
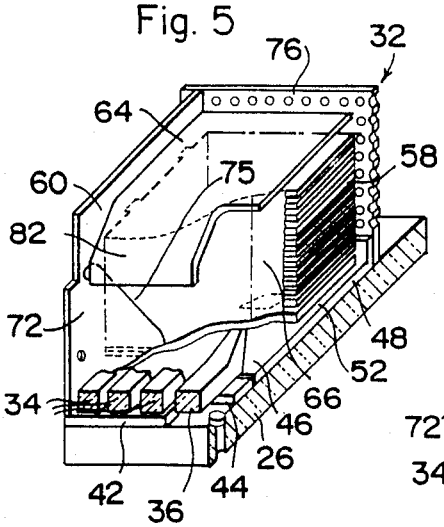
FIGS. 5 to 8 represent a perspective half-view of the breaking device of FIG. 3, at different stages of arc extinction in the course of circuit breaker opening.
Figure 6:
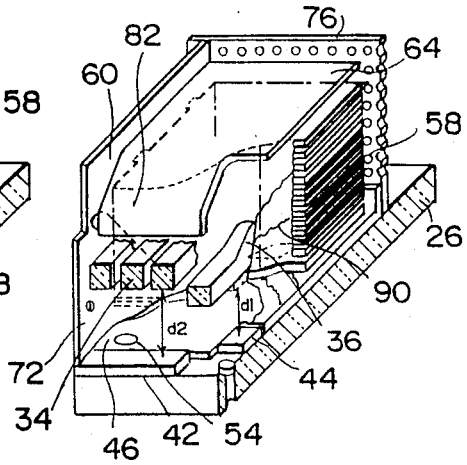
Figure 7:
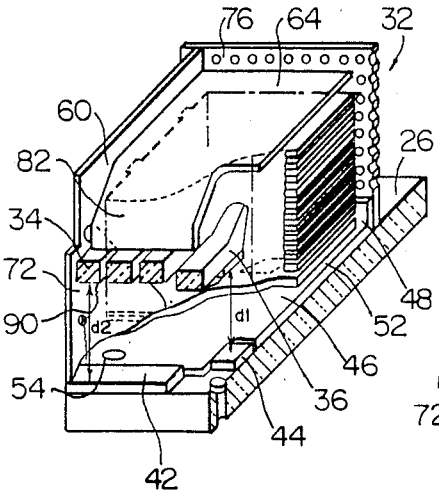
Figure 8:
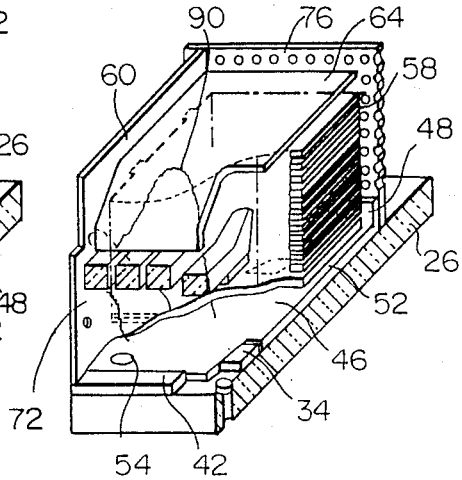

Referring now to FIGS. 2 to 4, the multiple contact system 30 of the breaking device 33 according to the invention is designed for a high-rating circuit breaker and comprises six movable main contacts 34 per pole arranged transversely along the bar 16 in two sets of three, on either side of a movable arcing contact 36 extending according to the longitudinal center line of the pole. The movable contacts 34, 36 are pivotally mounted on a common axis 37, being positioned in a tunnel 38 securedly united to the bar 16, with contact pressure springs 40 interposed. Electrical connection of the movable contacts 34, 36 with the terminal 28 is achieved by means of a flexible shunt (not shown).

The movable arcing contact 36 is of greater length than each movable main contact 34.

The terminal 26 located on the arc extinguishing chamber 32 side, bears stationary main contacts 42 and a stationary arcing contact 44, cooperating with the corresponding movable contacts 34, 36 in the closed position of the circuit breaker. On the upper face of the terminal 26 there is fixed a lower arcing horn 46 with an interposed shield 48 made of insulating material, notably polytetrafluorethylene-based. The shield 48 has a flat base situated under the arcing horn 46 and a rear edge 50 forming an obtuse angle with the flat portion. The arcing horn 46 is fixed to the terminal 26 by means of three screws 52, 54, 56, disposed at the peaks of an isoceles triangle. Two screws 54, 56 are located on either side of the arcing contact 44 at the rear of the stationary main contacts 42, and the screw 52 is situated along the center line XX' of the pole in the vicinity of the inclined edge 50 of the shield 48. The screws 52, 54, 56 can be replaced by rivets. The width of the lower arcing horn 46 decreases in the direction of the screw 52.

The arc extinguishing chamber 32 comprises a stacking of metal arc deionization plates 58, extending in an appreciably parallel direction to the terminal 26. The plates 58 are supported by two lateral flanges 60, 62 made of insulating material, and are surrounded heightwise by the shield 48 and lower arcing horn 46 assembly, and by an upper arcing horn 64. Each plate 58 of the chamber 32 has a V-shaped central recess or notch 66 disposed between two symmetrical, intermediate arc catching ridges 68, 70. The ridges 68, 70 can be straight in a parallel direction to the bar 16, or be dish-shaped. In the contact separation area bounding the arc formation chamber, there is located a pair of arc guiding jaws 72, 74 each having a first flat portion, laterally secured to the corresponding flange 60, 62, and a second inclined portion following the shape of the plates 58. At the rear of the chamber 32, there is arranged a gas outlet wall 76, extending perpendicularly to the flanges 60, 62, and to the plates 58. The upwards-inclined edge 50 of the insulating shield 48 penetrates into a gap 78 situated opposite from the jaws 72, 74, between the wall 76 and the rear edge of the separators 58. The wall 76 comprises outlet orifices 80 of the breaking gases to the external environment, and the upper arcing horn 64 is provided with a pair of front lugs 82, 84 folded downwards in an appreciably perpendicular direction to the plane of the terminal 26. Each lug 82, 84 of the upper arcing horn 64 is housed transversely between the corresponding jaw 72, 74, and a central space passing through the recesses 66 of the plates 58, and allowing the movable arcing contact 36 to move to the open position. The guiding jaws 72, 74 are made of a gas-producing insulating material, for example polytetrafluorethylene-based, and each having a bevelled rear ridge 75 giving the jaw a shape close to that of a trapezium.

Operation of the breaking device 33 according to the invention is illustrated in FIGS. 5 to 8 :

in the closed position (FIG. 5), the contact pressure of the multiple contact system 30 is provided by the springs 40, and the handle 20 is in the stable position indicated in bold lines in FIG. 1.

opening is controlled by the mechanism 14 after a fault current, of an intensity lower than the electrodynamic repulsion threshold, has been detected. At the beginning of circuit breaker opening, the movable main contacts 34 separate from the corresponding stationary main contacts 42, whereas the arcing contacts 44, 36 still remain closed. In the course of the continued opening travel of the mechanism 14, the separation phase of the arcing contacts 44, 36 occurs (FIG. 6), with formation of an arc 90 between the latter. The development of the arc 90 occurs in the central area of the chamber 32 only, given that the separation distance d1 between the arcing contacts 44, 36 is smaller than the distance d2 between the main contacts 42, 34 at the beginning of the opening travel. The arc forms a migration loop, along an extension of the movable arcing contact 36, and on a track of the lower arcing horn 46 forming a first path, from the stationary arcing contact 34 to the central fixing screw 52 on the terminal 26. The presence of this screw 52 enables the arc root to be stabilized in an intermediate position of the track (see Figure). The lower arcing horn 46 is made of steel enabling the translation movement of the arc on the migration track to be slowed down.

at the end of the opening travel (FIG. 7), the separation distance d1 between the arcing contacts 44, 36 becomes greater than the distance d2 between the main contacts 42, 34 resulting in restriking of the arc 90 at the level of the main contacts 42, 34. The reversal of the distances d1 and d2 in relation to the beginning of opening phase illustrated in FIG. 6 results from the variation of the pivoting radii of the movable main 34 and arcing contacts 36. A small gap separates the movable main contacts 34 from the lugs 82, 84 of the upper arcing horn 64.

the arc 90 then develops on a second different path, along one side of the chamber 32 (FIG. 8) following the slot of the plates 58 up to the level of the intermediate ridges 68 or 70. The presence of the guiding jaw 72 or 74 enables the arc root to be rapidly recentered along the lower arcing horn 46. The arc 90 encounters cold surfaces along this second path where an efficient absorption of energy takes place favorable to arc extinction.

I claim:

1. A breaking device for a multipole electrical circuit breaker with a molded insulating case, housing an operating mechanism coupled to a switching bar to provide closing and opening of all the circuit breaker poles, each pole comprising :

a pair of fixed current-conducting terminals, bearing on the base of the case, an arc extinguishing chamber disposed above the first terminal, and comprising a stacking of metal arc deionization plates, each plate having a V-shaped notch, a multiple contact system having a plurality of identical movable main contacts, divided into two sets of the same number on either side of a movable arcing contact extending longitudinally according to the center line of the pole, said contacts being pivotally mounted on an axis of a support tunnel securedly united to the bar, and cooperating with corresponding stationary contacts fixed on the internal end of the first terminal, the length of the movable arcing contact being greater than that of each movable main contact, a pair of lower and upper arcing horns surrounding the stacking of arc extinguishing chamber plates, the lower arcing horn being securedly united to the upper face of the first terminal with an insulating shield interposed, a pair of arc guiding jaws arranged in the arc extinguishing chamber, each jaw, made of gas-producing insulating material, having an inclined portion following the outline of the plates up to the vicinity of an intermediate arc catching ridge, the lower arcing horn being fixed to the first terminal by means of three screws or rivets disposed at the peaks of an isoceles triangle, the first of the screws being situated along the center line of the pole in the vicinity of an edge of the insulating shield penetrating into a rear gap arranged between the plates and an outlet wall of the breaking gases to the outside.

2. The breaking device according to claim 1, wherein the width of the lower arcing horn decreases in the migration direction of the arc towards said center screw, the second and third screws being located on either side of the stationary arcing contact, and in the vicinity of the corresponding stationary main contacts.

3. The breaking device according to claim 1, wherein the two intermediate ridges of each plate are arranged symmetrically in relation to the center line passing through the center notch, and extend in a parallel direction to the bar.

4. The breaking device according to claim 1, wherein the lower arcing horn is made of steel.

5. The breaking device according to claim 1, wherein the upper arcing horn is equipped with a pair of front lugs folded downwards in the direction of the terminal and opposite from the rear gap of the chamber.

* * * * *